US010398617B2

(12) United States Patent
Simon et al.

(10) Patent No.: US 10,398,617 B2
(45) Date of Patent: Sep. 3, 2019

(54) ADJUSTABLE POSITION PIVOT FOR MEDICAL ASSIST DEVICE

(71) Applicant: STEERING SOLUTIONS IP HOLDING CORPORATION, Saginaw, MI (US)

(72) Inventors: Daniel C. Simon, Freeland, MI (US); Travis L. Palmer, Frankenmurth, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 1162 days.

(21) Appl. No.: 14/699,390

(22) Filed: Apr. 29, 2015

(65) Prior Publication Data

US 2016/0317374 A1 Nov. 3, 2016

(51) Int. Cl.
*A61H 1/02* (2006.01)
*A61H 3/00* (2006.01)

(52) U.S. Cl.
CPC ..... *A61H 3/00* (2013.01); *A61H 1/0244* (2013.01); *A61H 1/0262* (2013.01);
(Continued)

(58) Field of Classification Search
CPC .... A61H 1/0262; A61H 1/0244; A61H 1/262; A61H 3/00; A61H 2201/1628; A61H 2201/165; A61H 2201/1676; Y10T 403/32442; Y10T 403/32475; Y10T 403/32508; Y10T 403/32467; A61F 2005/0132; A61F 2005/0155; A61F 2005/0158; A61F 2005/016;
(Continued)

(56) References Cited

U.S. PATENT DOCUMENTS 7,404,782 B2 7/2008 Kudoh et al.
7,429,253 B2 9/2008 Shimada et al.
(Continued)

FOREIGN PATENT DOCUMENTS

CN 101132753 A 2/2008
CN 102811938 12/2012
(Continued)

OTHER PUBLICATIONS

Chinese Office Action and Search Report for Chinese Application No. 201610276134.5 dated Jun. 26, 2017 with English Translation, 9 pages.
(Continued)

*Primary Examiner* — Colin W Stuart
*Assistant Examiner* — Douglas Y Sul

(57) ABSTRACT

In one exemplary embodiment of the present invention, an adjustable joint actuator assembly for a medical assist device is provided. The assembly includes a support arm extending along a longitudinal axis, a gearbox rotatably coupled to the support arm about the longitudinal axis and slidable along the longitudinal axis, and a locking mechanism inserted over a portion of the support arm and the gearbox to facilitate preventing movement of the gearbox relative to the support arm along the longitudinal axis. The locking mechanism is configured for removal to enable movement of the gearbox relative to the support arm along the longitudinal axis.

9 Claims, 3 Drawing Sheets

(52) U.S. Cl.
CPC ..... *A61H 2201/123* (2013.01); *A61H 2201/1215* (2013.01); *A61H 2201/1253* (2013.01); *A61H 2201/164* (2013.01); *A61H 2201/165* (2013.01); *A61H 2201/1623* (2013.01); *A61H 2201/1628* (2013.01); *A61H 2201/1676* (2013.01)

(58) Field of Classification Search
CPC ..... A61F 2005/0165; A61F 2005/0167; A61F 2005/0181; A61F 2005/0183; B25J 9/0006
USPC ..... 602/16
See application file for complete search history.

(56) References Cited

U.S. PATENT DOCUMENTS

| | | | | |
|---|---|---|---|---|
| 7,628,766 | B1 * | 12/2009 | Kazerooni | A61F 5/00 602/16 |
| 2004/0106881 | A1 | 6/2004 | McBean et al. | |
| 2006/0052731 | A1 * | 3/2006 | Shimada | A61F 5/0102 602/5 |
| 2010/0249673 | A1 | 9/2010 | Nef et al. | |
| 2014/0276265 | A1 * | 9/2014 | Caires | A61H 3/00 601/34 |
| 2014/0358053 | A1 | 12/2014 | Triolo et al. | |
| 2015/0272810 | A1 * | 10/2015 | Teng | A61H 1/024 601/34 |
| 2016/0045385 | A1 | 2/2016 | Aguirre-Ollinger et al. | |
| 2016/0045387 | A1 * | 2/2016 | Lee | A61H 3/008 602/12 |
| 2016/0317375 | A1 | 11/2016 | Simon et al. | |
| 2017/0252254 | A1 * | 9/2017 | Velazquez Nino | A61H 3/00 |

FOREIGN PATENT DOCUMENTS

| | | | |
|---|---|---|---|
| CN | 103200919 | A | 7/2013 |
| CN | 104068950 | A | 10/2014 |
| CN | 104188675 | A | 12/2014 |
| JP | 2011019669 | A | 2/2011 |
| JP | 2012217746 | A | 11/2012 |
| KR | 100731899 | B1 | 6/2007 |
| TW | 201330843 | A | 8/2013 |
| WO | 2012070244 | A1 | 5/2012 |
| WO | 2013019749 | A1 | 2/2013 |
| WO | 2014093470 | A1 | 6/2014 |
| WO | 2014138871 | A1 | 9/2014 |

OTHER PUBLICATIONS

Chinese Office Action and Search Report for Chinese Application No. 201610533896.9 dated Dec. 4, 2017with English Translation, 13 pages.
European Search Report for EP Application No. 16160267.7 dated Oct. 5, 2016.
European Search Report for EP Application No. 16163383.9 dated Oct. 6, 2016.

* cited by examiner

ADJUSTABLE POSITION PIVOT FOR MEDICAL ASSIST DEVICE

FIELD OF THE INVENTION

The following description relates to medical assist devices and, more specifically, to an adjustable exoskeleton device.

BACKGROUND

Some exoskeleton devices may be used to assist medical patients with one or more movements. For example, exoskeleton devices may be provided for the arms or legs of a user. Where a user has full use of the limb supported by the exoskeleton device, it may be used to enhance natural abilities such as load carrying. Where the user has impaired use of the limb supported by the exoskeleton device, it may be used for rehabilitative purposes or to replicate a full physical function. Such devices may be powered by one or more motors coupled to gears or pulleys configured to move a user's limb in a desired motion, such as walking.

However, some exoskeleton devices are not adjustable and may not fit some users due to size constraints. Accordingly, it is desirable to provide an exoskeleton device that is adjustable to fit different sized users.

SUMMARY OF THE INVENTION

In one exemplary embodiment of the present invention, an adjustable joint actuator assembly for a medical assist device is provided. The assembly includes a support arm extending along a longitudinal axis, a gearbox rotatably coupled to the support arm about the longitudinal axis and slidable along the longitudinal axis, and a locking mechanism inserted over a portion of the support arm and the gearbox to facilitate preventing movement of the gearbox relative to the support arm along the longitudinal axis. The locking mechanism is configured for removal to enable movement of the gearbox relative to the support arm along the longitudinal axis.

In another exemplary embodiment of the present invention, an adjustable medical assist device is provided. The device includes a support frame including a support arm extending along a longitudinal axis, a gearbox rotatably coupled to the support arm about the longitudinal axis and slidable along the longitudinal axis, and a leg support operably coupled to the gearbox, the gearbox configured to provide a rotational force to the leg support. A locking mechanism is inserted over a portion of the support arm and the gearbox to facilitate preventing movement of the gearbox relative to the support arm along the longitudinal axis. The locking mechanism is configured for removal to enable movement of the gearbox relative to the support arm along the longitudinal axis.

In yet another exemplary embodiment of the present invention, a method of assembling an adjustable medical assist device is provided. The method includes providing a support frame including a support arm extending along a longitudinal axis, providing a gearbox, and coupling the gearbox to the support arm such that the gearbox is rotatable about the longitudinal axis and slidable along the support arm along the longitudinal axis. The method further includes coupling a leg support to the gearbox such that the gearbox is configured to provide a rotational force to the leg support, and inserting a locking mechanism over a portion of the support arm and the gearbox to facilitate preventing movement of the gearbox relative to the support arm along the longitudinal axis, the locking mechanism configured for removal to enable movement of the gearbox relative to the support arm along the longitudinal axis.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
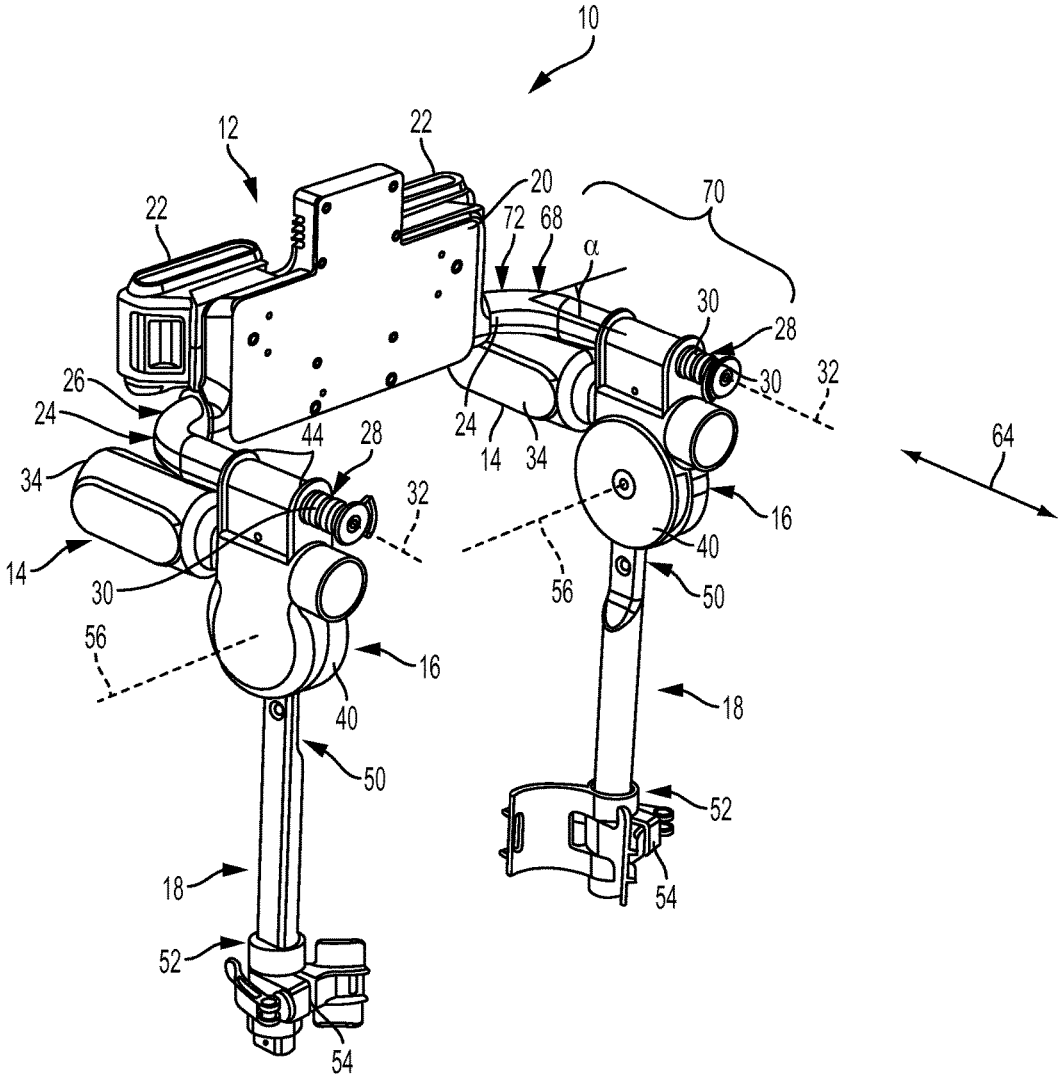
FIG. 1 is a perspective view of an exemplary adjustable medical assist device.

Referring now to the Figures, where the invention will be described with reference to specific embodiments, without limiting same, FIG. 1 illustrates an exemplary adjustable exoskeleton or medical assist device 10. In the exemplary embodiment, adjustable device 10 generally includes a support frame 12, a pair of motor assemblies 14 each respectively associated with a gearbox 16, and a pair of leg supports 18.

Support frame 12 is configured to be disposed about a user's torso or hips and includes a back support 20, one or more power source 22 (e.g., a battery), a controller (not shown), and a pair of hip supports or support arms 24 extending from back support 20. Back support 20 is configured to rest against a user's back, power source 22 is configured to power motor assembly 14, and the controller is configured to selectively control motor assembly 14 and/or movement of gearbox 16. As used herein, the term controller refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 2:
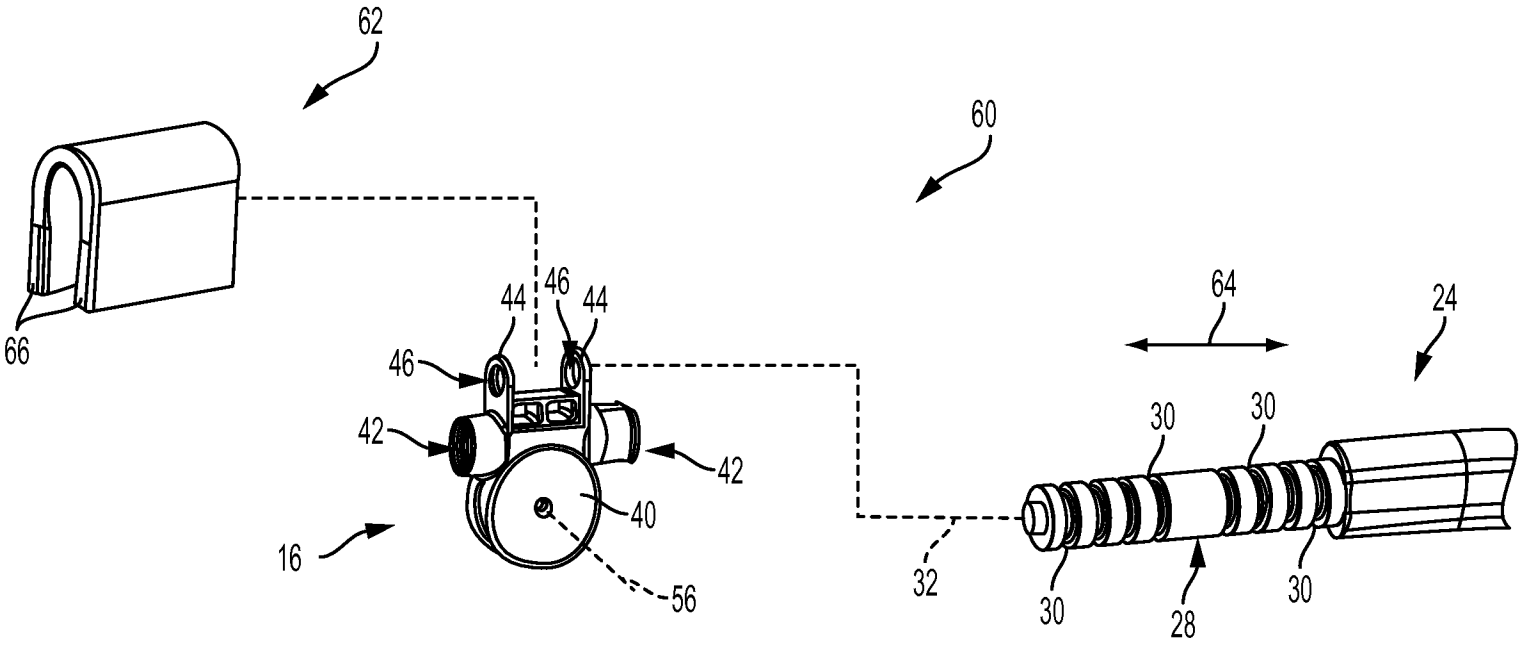
FIG. 2 is perspective view of an exemplary gearbox assembly of the device shown in FIG. 1 before assembly.

With additional reference to FIG. 2, support arms 24 each include a proximal end 26 and a distal end 28. Proximal end 26 is coupled to back support 20, and distal end 28 includes a plurality of adjustment notches or grooves 30 formed therein. Distal end 28 extends along a longitudinal axis 32 and has a circular or generally circular cross-section.

In the exemplary embodiment, motor assembly 14 includes a housing 34, one or more motors (not shown), and an output shaft (not shown) operatively associated with gearbox 16. Motor assembly 14 is configured to apply a torque to gearbox 16 to selectively rotate leg support 18, thus enabling a user's hip joint to be extended or bent.

With further reference to FIG. 2, gearbox 16 is configured to assist and support a user's hip movement and generally includes a housing 40, a motor assembly aperture 42, an internal gear system (not shown), and pivot flanges 44. Motor assembly aperture 42 is configured to receive at least a portion of motor assembly 14 (e.g., the motor output shaft)

such that motor assembly 14 is operably coupled to gearbox 16. The gear system is disposed within housing 40 and is operably coupled to the motor output shaft. Pivot flanges 44 extend outwardly from housing 40 and define apertures 46 configured to receive distal end 28 of support arm 24. As such, gearbox 16 is configured to rotate about longitudinal axis 32 of an associated support arm 24 to facilitate hip flexion and extension while pivot 44 allows for, but does not force, hip adduction and abduction.

In the exemplary embodiment, leg support 18 is configured to support a user's upper leg and includes a proximal end 50, a distal end 52, and a leg clamp 54. Proximal end 50 is coupled to the gear system of gearbox 16 such that leg support 18 is rotatable about an axis 56, and leg clamp 54 is coupled to distal end 52. Leg clamp 54 is configured to connect to a user's leg, for example, by a strap connected directly to clamp 54.

Figure 3:
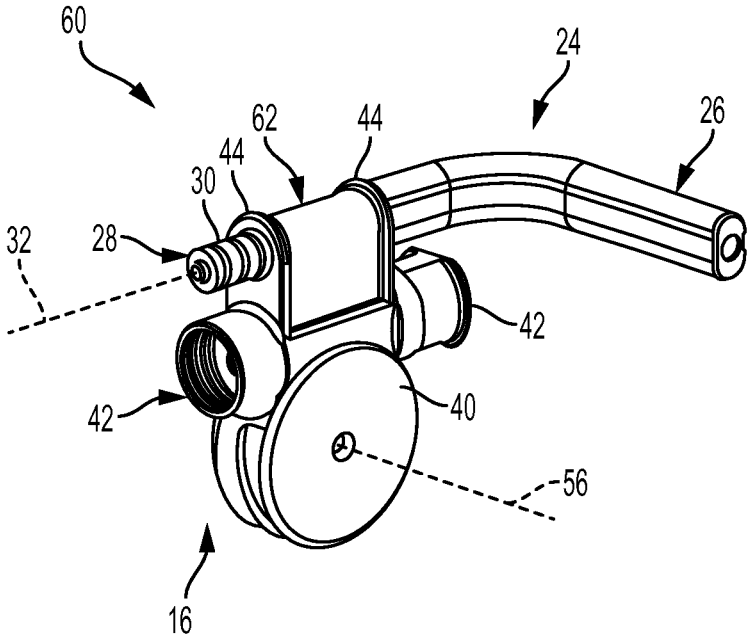
FIG. 3 is a perspective view of the gearbox assembly shown in FIG. 2 after assembly.

FIGS. 2 and 3 illustrate an exemplary hip joint actuator assembly 60 that generally includes gearbox 16, support arm 24, and a locking mechanism or pivot joint cover 62. FIG. 2 illustrates assembly 60 before assembly, and FIG. 3 illustrates assembly 60 after it has been assembled. Actuator assembly 60 is selectively adjustable in the fore/aft direction illustrated by arrows 64 (FIGS. 3 and 4) to enable medical assist device 10 to conform and fit various sized users, as describe herein in more detail.

Figure 4:
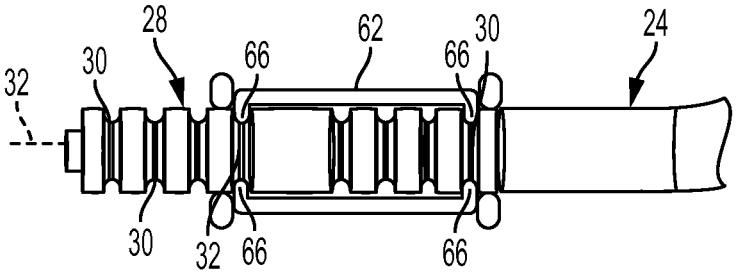
FIG. 4 is a cross-sectional view of the gearbox assembly shown in FIG. 3 and taken along line 4-4.

During assembly, support arm distal end 28 is inserted into apertures 46 of gearbox pivot flanges 44, and pivot joint cover 62 is inserted over gearbox housing 40 between pivot flanges 44. At this point, as illustrated in FIGS. 2 and 4, inwardly extending flanges 66 of pivot joint cover 62 are seated within grooves 30 formed in support arm distal end 28, which locks and prevents movement of gearbox 16 relative to support arm 24 in the direction of arrows 64 along axis 32.

To adjust medical assist device 10, pivot joint cover 62 may be removed, which enables fore/aft movement of gearbox 16 along support arm distal end 28 in the direction of arrows 64. Once in a desired position, pivot joint cover 62 is again inserted over gearbox housing 40 such that flanges 66 are seated within grooves 30 to lock and prevent further relative movement between gearbox 16 and support arm 24.

In one embodiment, medical assist device 10 may include an angular adjustment 68 to provide further adaptability to various sized users. For example, support arm 24 may include a first portion 70 that is movable inwardly and outwardly relative to a second portion 72. As such, support arm first portion 70 may be oriented in a desired position at an angle '$\alpha$' relative to support arm second portion 72. In one embodiment, angle '$\alpha$' is between −30° and 60°. In another embodiment, angle '$\alpha$' is between 0° and 60°. In one embodiment, angle '$\alpha$' is approximately 90°+/− approximately 20°. In another embodiment, angle '$\alpha$' is 90°+/−20°.

A method of assembling medical assist device 10 includes providing support frame 12, motor assembly 14, gearbox 16, and leg support 18. Motor assembly 14 and leg support 18 are operably coupled to the gear system of gearbox 16 to transfer rotary motion therebetween. Support arm distal end 28 is inserted into gearbox pivot flanges 44, and pivot joint cover 62 is inserted over a portion of gearbox 16 and support arm distal end 28 such that inwardly extending flanges 66 are seated within grooves 30 to enable rotational movement between gearbox 16 and support arm 28 about axis 32 and to facilitate preventing relative movement therebetween along axis 32.

Described herein are systems and methods that provide an adjustable medical assist device. The systems include a support arm with a plurality of grooves that is inserted into a gearbox. A cover is installed over a portion of the support arm and the gearbox such that flanges of the cover are disposed within the groves to prevent movement of the gearbox axially along the support arm. When the cover is removed, the axial positioning of the gearbox along the support arm is adjustable to provide the best fit for the current individual using the medical assist device.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

The invention claimed is:

1. An adjustable joint actuator assembly for a medical assist device, the assembly comprising:

a support arm extending along a longitudinal axis;

a gearbox rotatably coupled to the support arm about the longitudinal axis and slidable along the longitudinal axis, the gearbox including a housing and a pair of pivot flanges each defining an aperture to receive the support arm; and a locking mechanism inserted over a portion of the support arm and the gearbox and between the pair of pivot flanges to facilitate preventing movement of the gearbox relative to the support arm along the longitudinal axis, the locking mechanism configured for removal to enable movement of the gearbox relative to the support arm along the longitudinal axis.

2. The assembly of claim 1, wherein the support arm includes a plurality of grooves formed therein.

3. The assembly of claim 2, wherein the locking mechanism includes at least one flange that is disposed within at least one groove of the plurality of grooves when the locking mechanism is inserted over the portion of the support arm and the gearbox.

4. An adjustable medical assist device comprising:

a support frame including a support arm extending along a longitudinal axis;

a gearbox rotatably coupled to the support arm about the longitudinal axis, slidable along the longitudinal axis, and including a housing and a pair of pivot flanges each defining an aperture to receive the support arm, the gearbox further including a motor assembly aperture to receive at least a portion of a motor assembly;

a leg support operably coupled to the gearbox, the gearbox configured to provide a rotational force to the leg support; and a locking mechanism inserted over a portion of the support arm and the gearbox between the pair of pivot flanges to facilitate preventing movement of the gearbox relative to the support arm along the longitudinal axis, the locking mechanism is configured for removal to enable movement of the gearbox relative to the support arm along the longitudinal axis.

5. The device of claim 4, wherein the support arm includes a plurality of grooves formed therein.

6. The device of claim 5, wherein the locking mechanism includes at least one flange that is disposed within at least one groove of the plurality of grooves when the locking mechanism is inserted over the portion of the support arm and the gearbox.

7. The device of claim 4, wherein the motor assembly is operatively coupled to the gearbox to transfer rotary motion thereto.

8. The device of claim 4, wherein the support arm includes a first portion and a second portion, the first portion selectively adjustable relative to the second portion to orient the first portion at a desired angle relative to the second portion.

9. A method of assembling an adjustable medical assist device, the method comprising:

providing a support frame including a support arm extending along a longitudinal axis;

providing a gearbox including a housing and a pair of pivot flanges each pivot flange defining an aperture to receive the support arm;

coupling the gearbox to the support arm such that the gearbox is rotatable about the longitudinal axis and slidable along the support arm along the longitudinal axis;

coupling a leg support to the gearbox such that the gearbox is configured to provide a rotational force to the leg support; and inserting a locking mechanism over a portion of the support arm and the gearbox and between the pair of pivot flanges to facilitate preventing movement of the gearbox relative to the support arm along the longitudinal axis, the locking mechanism configured for removal to enable movement of the gearbox relative to the support arm along the longitudinal axis.

* * * * *